US008398416B2

(12) United States Patent
Tseng

(10) Patent No.: US 8,398,416 B2
(45) Date of Patent: Mar. 19, 2013

(54) SOCKET CONNECTOR HAVING DETECTING SWITCH

(75) Inventor: Tingchang Tseng, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/145,869

(22) PCT Filed: Jan. 25, 2010

(86) PCT No.: PCT/CN2010/000111

§ 371 (c)(1),
(2), (4) Date: Sep. 29, 2011

(87) PCT Pub. No.: WO2010/083731

PCT Pub. Date: Jul. 29, 2010

(65) Prior Publication Data

US 2012/0015554 A1 Jan. 19, 2012

(30) Foreign Application Priority Data

Jan. 23, 2009 (CN) ..... 2009 2 0003342 U
Jan. 23, 2009 (CN) ..... 2009 2 0003343 U
Jan. 23, 2009 (CN) ..... 2009 2 0003344 U

(51) Int. Cl.
*H01R 24/00* (2006.01)

(52) U.S. Cl. ..... 439/188; 439/660; 439/489

(58) Field of Classification Search ..... 439/660, 439/188, 489
See application file for complete search history.

(56) References Cited

U.S. PATENT DOCUMENTS 7,077,668 B2 * 7/2006 Lapidot et al. ..... 439/108
7,371,116 B2 * 5/2008 Chiang ..... 439/607.34
7,517,253 B1 4/2009 Chiang
7,600,069 B2 * 10/2009 Lin ..... 710/315
7,758,379 B2 * 7/2010 Chen ..... 439/607.11
7,988,499 B2 * 8/2011 Lin et al. ..... 439/701
8,109,795 B2 * 2/2012 Lin et al. ..... 439/660
2007/0173121 A1 7/2007 Chiang
2007/0218762 A1 9/2007 Liao et al.

FOREIGN PATENT DOCUMENTS

CN 201332194 Y 10/2009
CN 201365045 Y 12/2009

OTHER PUBLICATIONS

International Search Report for PCT/CN2010/000111.

* cited by examiner

*Primary Examiner* — Gary F. Paumen
(74) *Attorney, Agent, or Firm* — Stephen L. Sheldon

(57) ABSTRACT

A socket connector comprises a housing, a shield covering the housing and a detecting switch mounted in the housing. The housing includes a base and a pinboard having a first board surface and a second board surface. An eSATA terminal set having seven terminals side by side is mounted on the first board surface. An USB terminal set having nine terminals is mounted on the second board surface and five terminals are connected to the five middle terminals of the eSATA terminal set to form a shared terminal structure. The shield has a shared inserting room which includes a first inserting room for connecting an eSATA plug connector and a second inserting room for connecting an USB plug connector, the second inserting room having a nonoverlapping space relative to the first inserting room. The detecting switch includes a first detecting terminal that extends into the nonoverlapping space.

11 Claims, 18 Drawing Sheets

SOCKET CONNECTOR HAVING DETECTING SWITCH

RELATED APPLICATIONS

This application is a national phase of PCT Application No. PCT/CN2010/000111, filed Jan. 25, 2010, which in turn claims priority to Chinese Application No. 200920003342.3, filed Jan. 23, 2009, to Chinese Application No. 200920003343.8, filed Jan. 23, 2009, and to Chinese Application No. 200920003344.2, filed Jan. 23, 2009, all of which are incorporated herein by reference in their entirety.

TECHNICAL FIELD

The present invention relates to a socket connector and in particular, relates to a socket connector having a detection switch available for alternating plug-in by an eSATA plug connector and a USB plug connector.

BACKGROUND ART

Existing electric connectors already have designs available for alternate plugging in by plug connectors with different specifications. For example, FIG. 1 to FIG. 3 show a connector socket disclosed by Taiwan patent M335829 (application number: 97202149), comprising a casing 11, on which there are a slot 111 and fixed seat 12 in slot 111. An External Serial Advanced Technology Attachment (eSATA) terminal set 13 and a universal serial bus (USB) terminal set 14 are placed on the two opposite sides of fixed seat 12. External Serial Advanced Technology Attachment terminal set 13 has a plurality of first eSATA terminals 131 and second eSATA terminals 132. Universal serial bus terminal set 14 has a plurality of first USB terminals 141 and second USB terminals 142, and the second USB terminals 142 are connected to corresponding second eSATA terminals 132, so that the connector socket supports a USB 3.0 plug-in connector and is connected to the corresponding second eSATA terminals 132 through second USB terminals 142 in order to transmits signals.

The aforementioned patent discloses a composite connector, which is a shared socket and wherein second USB terminals 142 and second eSATA terminals 132 are integrally connected to form a shared terminal structure. However, both the shared second USB terminals 142 and the connecting part 1421 of second eSATA terminals 132 extend vertically upward from the ends of second eSATA terminals 132, because the pitch between these shared second USB terminals 142 is greater than the pitch between second eSATA terminals 132. Therefore, the deviation length of connecting part 1421 is greater toward the outer side. When transmitting a USB signal, the greater the signal path is toward the outer side, the greater the length of the signal is, thus generating a signal misjudgment and signal distortion issue.

Due to the arrangements of the shared terminals, the aforementioned patent discloses that in vertical connecting part 1421, the more connecting part 1421 goes toward the outer side, it has a location with a narrow width in its middle. This location with a narrow width is smaller than the width of the contact part between second eSATA terminals 132 and second USB terminals 142, thus causing resistance to be greater due to a shrinkage of the transmission path and further causing a USB signal transmission delay or distortion issue.

Next, the structure of the aforementioned shared terminals has another issue, which is how to switch signal transmissions between different types. The aforementioned patent does not have a design to detect the switch structure for use in the transmission of switching signals.

In addition, although the structure of a detection switch is a very common structure generally in a plurality of connectors, it is set up generally for a single connector. In terms of the demand of some industries, especially in regard to USB connectors, there is a demand for setting up detection switches, because a USB has a signal terminal and a power terminal, one of which has a demand to detect the provision of signals and power after a USB plug-in connector is plugged in and positioned. Another demand is to detect the provision of power after a USB plug-in connector is plugged in and positioned, with the equipment end being turned off, or there is a demand for other detection functions. However, the aforementioned patent does not have a detection switch, and is therefore not able to provide the function wherein such a connector socket can detect whether the USB plug-in connector can be plugged in as well as provide a function whereby the USB plug-in connector can successfully switch signal transmission while being alternatingly plugged in with the eSATA plug-in connector.

SUMMARY OF THE INVENTION

An example provides a socket connector having a detection switch, which comprises an housing. The housing has a front end and a rear end opposite to each other and the housing comprises a base part and an inserting board connected to the base part. The inserting board has a first board surface and a second board surface opposite to each other; the first board surface has an External Serial Advanced Technology Attachment terminal set with seven terminals side by side; the second board surface has a universal serial bus terminal set with nine terminals. Five of the terminals side by side of the universal serial bus terminal set are the first USB terminal set and the remaining four terminals side by side are the second USB terminal set. The first USB terminal set is placed on the front end of the second place surface. The second USB terminal set is placed on the second board surface and is located at the rear of the first USB terminal set, wherein five of the terminals side by side of the first USB terminal set are respectively and correspondingly connected to the five terminals at a central location of the External Serial Advanced Technology Attachment terminal set, constituting the structure for a shared terminal; and a shield. The shield covers the housing and constitutes a shared inserting space. The shared inserting space comprises a first inserting space for plugging in an eSATA plug-in connector and a second inserting space for plugging in a corresponding type A USB plug-in connector. The first inserting space and the second inserting space have a partial overlapping space and a partial non-overlapping space. The housing has a detection switch. The detection switch comprises a first detection terminal and a second detection terminal. A pressure contact part protrudes from the first detection terminal. The contact part protrudes out and extends into the second inserting space on the side of the second board surface of the inserting board and is located in the non-overlapping partial space of the first inserting space and the second inserting space; when the eSATA plug-in connector is inserted into the second inserting space, it will not be pressed against the pressure contact part of the first detection terminal; when the USB plug-in connector is inserted into the second inserting space, it will be pressed against the pressure contact part of the first detection terminal, so that the first detection terminal moves relative to the second detection terminal, breaking over the detection switch.

DETAILED DESCRIPTION OF THE PREFERRED EMBODIMENTS

Figure 1:
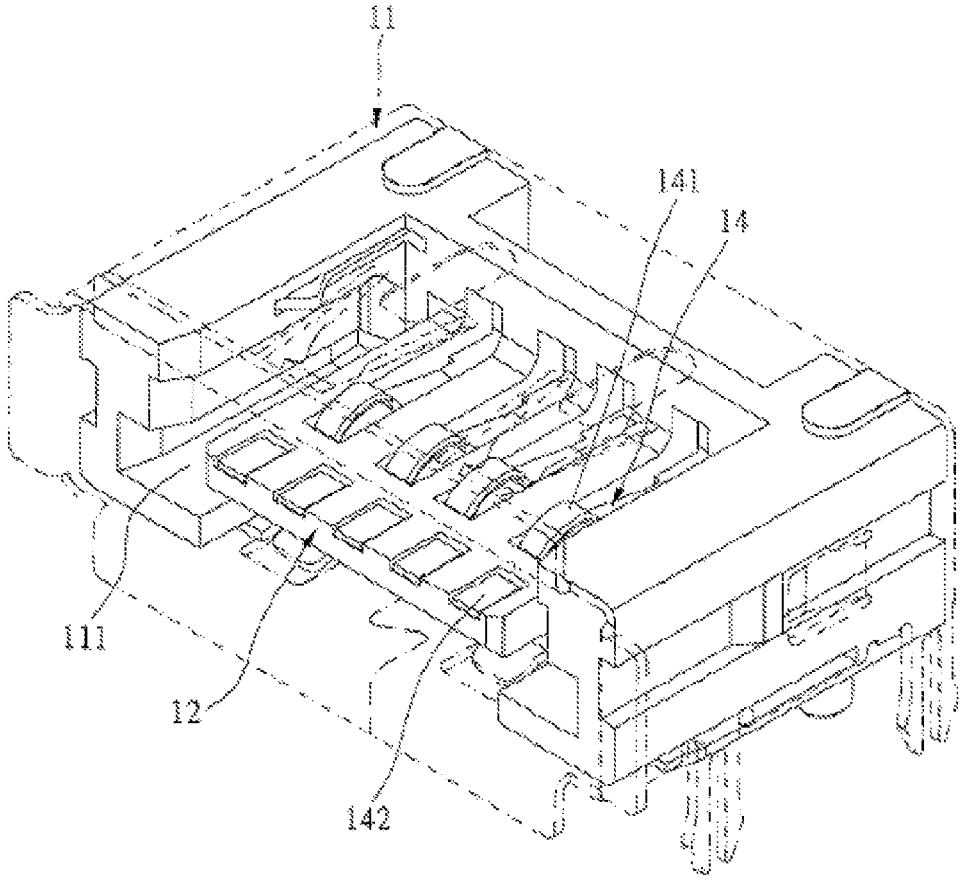
FIG. 1 is a three dimensional view of an existing connector socket.
Figure 2:
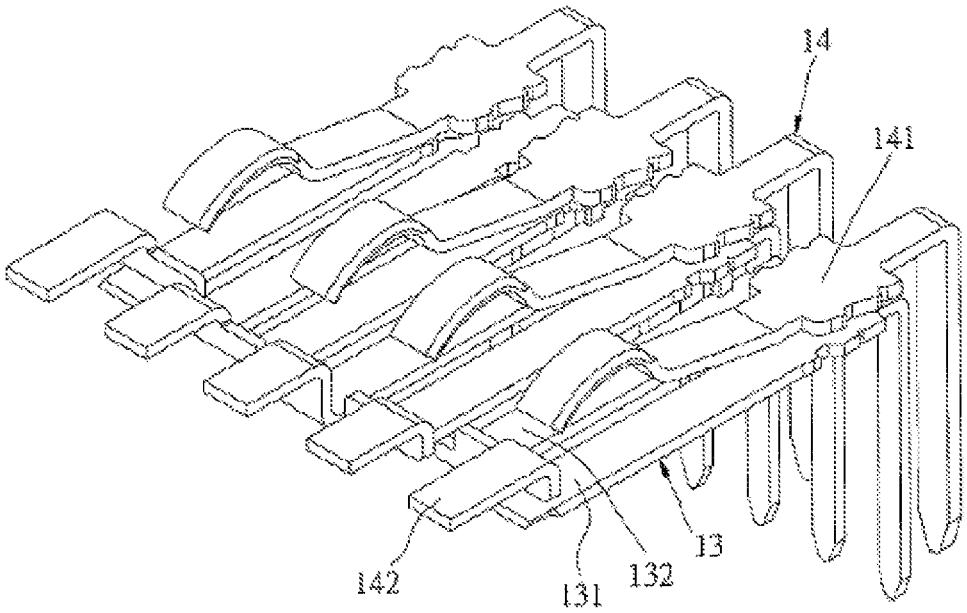
FIG. 2 is a three-dimensional view of the terminal set of an existing connector socket.
Figure 3:
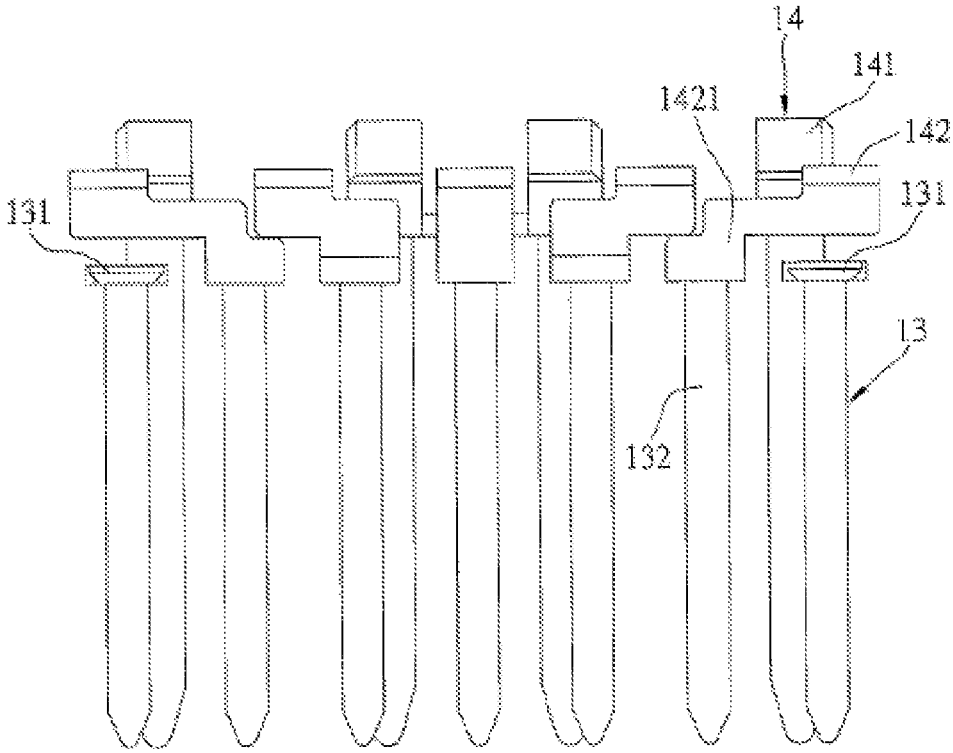
FIG. 3 is the front view of FIG. 2.

A purpose of the present invention is to provide a socket connector having a detection switch and being capable of providing a USB plug connector within a composite inserting space, that can trigger a detection switch, thus changing the connection status of the detection switch, in order to transmit a USB transmission signal; as well as a meeting demand for providing detection functions. Another purpose of the present invention is to provide a socket connector which allows the connecting part of a shared terminal to have similar lengths and widths, so that the transmission paths of signals are close, reducing the deflection in the transmission of a USB signal and avoiding the occurrence of signal misjudgment and signal distortion. A further purpose of the present invention is to provide a socket connector which allows the connecting part of a shared terminal to have similar lengths and widths, so as to reduce the impedance effect and reduce the delay or distortion of USB signal transmission.

In an embodiment, the first detection terminal comprises a first fixed part affixed onto the housing, the pressure contact part bends and extends from the direction of one end of the fixed part and the first welded pin extends from the other end of the fixed part. The second detection terminal comprises a second fixed part affixed onto the housing, a contact part that bends and extends from the direction of one end of the second fixed part and that is located in the rear of the pressure contact part as well as a second welded pin extending from the other end of the second fixed part; the housing has an installation slot for installation of the detection switch. The installation slot has an opening toward the direction of the second inserting space on one side of the board surface. The pressure contact part of the first detection terminal protrudes out of the opening.

In an embodiment, when the USB plug-in connector is inserted into the second inserting space, the front end of the insulating casing of the USB plug-in connector correspondingly presses against the pressure contact part of the first detection terminal of the detection switch.

In an embodiment, each of the terminals of the External Serial Advanced Technology Attachment has a first base arm, a contact arm extending from the first base arm and the first welded pin extending from the other, opposite end of the first base arm. The contact arms are located side by side on the first board surface of the inserting board. The first welded pins extend out of the rear end of the base part; each of the terminals of the second USB terminal set has a second base arm, a flexible contact arm bending and extending from one end of the second base arm and a second welded pin bending and extending from the other, opposite end of the second base arm. The flexible contact arms are located side by side on the second board surface of the inserting board. The second welded pins extend out of the rear end of the base part.

In an embodiment, the shared terminal is disposed into the inserting board of the housing. In an embodiment, the housing has four USB terminal slots and two eSATA terminal slots. The aforementioned four USB terminal slots are located side by side on the second board surface and extend to the rear end of the base part. The aforementioned two eSATA terminal slots are located on the two opposite ends of the first board surface and extend out of the rear end of the base part. In an embodiment, the shared terminal is disposed in the inserting board of the housing. In an embodiment, the housing has four USB terminal slots and two eSATA terminal slots. The aforementioned four USB terminal slots are located side by side on the second board surface and extend to the rear end of the base part. The aforementioned eSATA terminal slots are located on the two opposite sides of the first board surface and extend to the rear end of the base part. The first base arms of the two terminals on the outermost sides of the External Serial Advanced Technology Attachment are fastened onto the corresponding eSATA terminal slots and the contact arms are located in the corresponding eSATA terminal slots. The second base arms of each of the terminals of the second USB terminal set are fastened into the corresponding USB terminal slots and the flexible contact arms are located in the corresponding USB terminal slots. In an embodiment, each of the terminals of the first USB terminal set comprises a flat board contact part and a connecting part. One end of the contact part is connected to the flat board contact part, while the other end is connected to the terminal corresponding to the External Serial Advanced Technology Attachment terminal set.

In an embodiment, the connecting part of the middle terminals of the first USB terminal set bends and extends from the end of the corresponding terminal of the External Serial Advanced Technology Attachment, before forming the flat board contact part in a reverse direction. The connecting parts of the middle terminals on the two sides of the first USB terminal set respectively bend and extend from the ends of the contact arms of the terminals corresponding to the terminal set of the External Serial Advanced Technology Attachment and deviate and extend to opposite outer directions, before forming their flat board contact parts in a reverse direction. The connecting part of the two terminals on the outermost sides in the USB terminal set extends obliquely in a reverse outer side direction on the side from the opposite side direction near the end of the contact arms of the terminals corresponding to the External Serial Advanced Technology Attachment before extending its flat board contact part in an opposite outer side direction.

In an embodiment, a protruding arm extends from the two sides on the rear end of the base part of the housing. A terminal positioning seat is fastened onto the two protruding arms. Four sunken slots are placed side by side in the terminal positioning seat. The second welded pins of the second USB terminal set are respectively positioned in the corresponding sunken slots.

In an embodiment, a terminal holding block for the protruding arm of the housing is also fastened onto one side of the terminal positioning seat. The terminal holding block has a plurality of inserting slots. The first welded pins of each of the terminals of the External Serial Advanced Technology Attachment terminal set and the second welded pins of each of the blocks of the second USB terminal set respectively thread out of the corresponding threading slots.

In an embodiment, the aforementioned USB terminal set with nine terminals placed side by side are in compliance with the signal transmission protocol for type A connector terminals with a version under USB 3.0.

An embodiment also provides a socket connector that includes an housing. The housing has an opposite front end and rear end and the housing comprises a base part and an inserting board connected to the base part. The inserting board has an opposite first board surface and second board surface; the first board surface has an External Serial Advanced Technology Attachment terminal set with seven terminals placed side by side; the second board surface has a universal serial bus terminal set with nine terminals, wherein five terminals placed side by side are the first USB terminal set and the remaining four terminals are placed side by side on the second USB terminal set. The first USB terminal set is placed on the front end of the second board surface and the second USB terminal set is placed on the second board surface and is located on the rear end of the first USB terminal set, wherein five terminals of the first USB terminal set placed side by side respectively correspond to the five terminals integrally connected to the middle part of the External Serial Advanced Technology Attachment, forming a shared terminal structure.

The connector also includes a shield. The shield covers the housing and forms a shared inserting space. The shared terminal is disposed in the inserting board of the housing. Each terminal of the first USB terminal set comprises a flat board contact part and a connecting part. One end of the connecting part is connected to the flat board contact part, while the other end is connected to the corresponding terminal of the External Serial Advanced Technology Attachment, wherein the connecting part of the middle terminals of the first USB terminal set bends and extends from the end of the corresponding terminal of the External Serial Advanced Technology Attachment before forming its flat board contact part in a reverse direction; the connecting parts of the middle terminals on the two sides of the first USB terminal set respectively bend and extend from the ends of the corresponding terminals of the terminal set of the External Serial Advanced Technology Attachment and deviate and extend to opposite outer directions, before forming their flat board contact parts in a reverse direction; the first USB terminal set is located in the connecting part of the two terminals on the outermost sides and extends obliquely in a reverse outer side direction on the side from the opposite also side direction near the end of the contact arms of the terminals corresponding to the External Serial Advanced Technology Attachment before extending its flat board contact part in an opposite outer side direction.

In an embodiment, the shared inserting space comprises a first inserting space for plugging in an eSATA plug-in connector and a second inserting space for plugging in a corresponding type A USB plug-in connector. The first inserting space and the second inserting space have a partial overlapping space and a partial non-overlapping space; the insulation body has a detection switch. The detection switch comprises a first detection terminal and a second detection terminal. A pressure contact part protrudes from the first detection terminal. The pressure contact part protrudes out and extends into the second inserting space on the side of the second board surface of the inserting board and is located in the non-overlapping partial space of the first inserting space and the second inserting space. In an embodiment, the connecting part of each of the terminals of the first USB terminal set extends to an aligned position at the same level before forming its contact part in a reverse direction.

One of the benefits of a design of the connecting part of the aforementioned shared terminals and with similar length and width is that signal transmission paths are similar, thus reducing the deflection in the transmission of a USB signal and avoiding the occurrence of signal misjudgment and signal distortion and reducing the impedance effect and reducing the delay or distortion of USB signal transmission. Also, the design of such shared terminals makes it possible for such shared terminals to be shaped on the terminal feed belt. Therefore, after being shaped they can be jointly disposed in the inserting board of the housing, to facilitate the manufacturing process and enhance the bonding strength of the housing.

Through the design of the aforementioned connecting part of shared terminals, which has a similar width, the present invention reduces the impedance effect and reduces the delay or distortion of USB signal transmission. Also, the design of such shared terminals makes it possible for such shared terminals to be shaped on the terminal feed belt, so that after being shaped, they can be jointly disposed in the inserting board of the housing, to facilitate the manufacturing process and enhance the bonding strength of the housing.

Next, by designing a second inserting space that has a detection switch, that is located in a USB plug-in connector and that avoids the inserting space of an eSATA plug-in connector, the eSATA plug-in connector will not trigger the detection switch and will only trigger the detection switch when the USB plug-in connector is plugged in. In a composite inserting space, the detection functions of a USB plug-in connector that is plugged in are provided. Therefore, when an eSATA plug-in connector is plugged in, it will not push against the pressure contact part of the first detection terminal and will not change the connection status of the detection switch, thus enabling the eSATA terminal set of the socket connector to transmit a signal. When a corresponding USB plug-in connector is plugged in, it will press against the pressure contact part of the first detection terminal, thus changing the connection status of the detection switch, enabling the terminal in the eSATA terminal set connected to the USB terminal set to transmit the USB transmission signal. At the same time, the detection switch can also provide signal and power for the USB plug-in connector after it is plugged in and positioned, or provide power to detect the USB plug-in connector after it is plugged in and positioned when the equipment end has been turned off or meet other demand required for detection functions.

Figure 4:
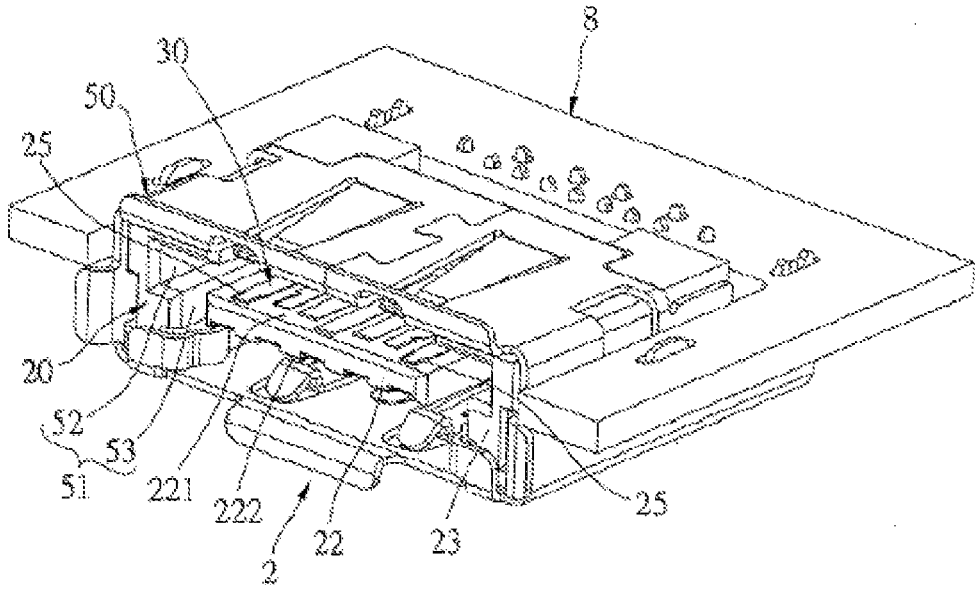
FIG. 4 is a three dimensional view of the socket connector in the present invention placed on a circuit board, which exhibits a sketch of the socket connector placed on the circuit board.
Figure 5:
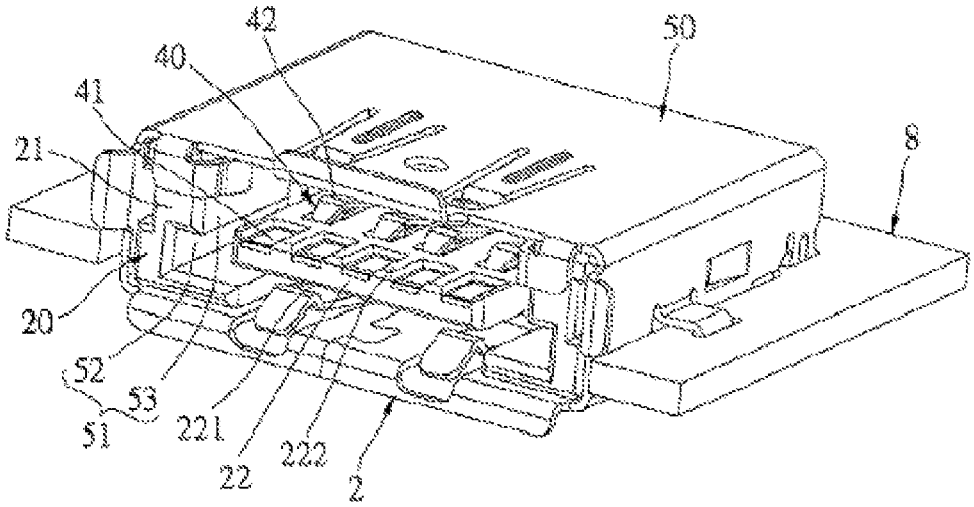
FIG. 5 is a three-dimensional view of the socket connector in the present invention placed on the circuit board, which exhibits a sketch of the socket connector relative to a reversed FIG. 4.
Figure 6:
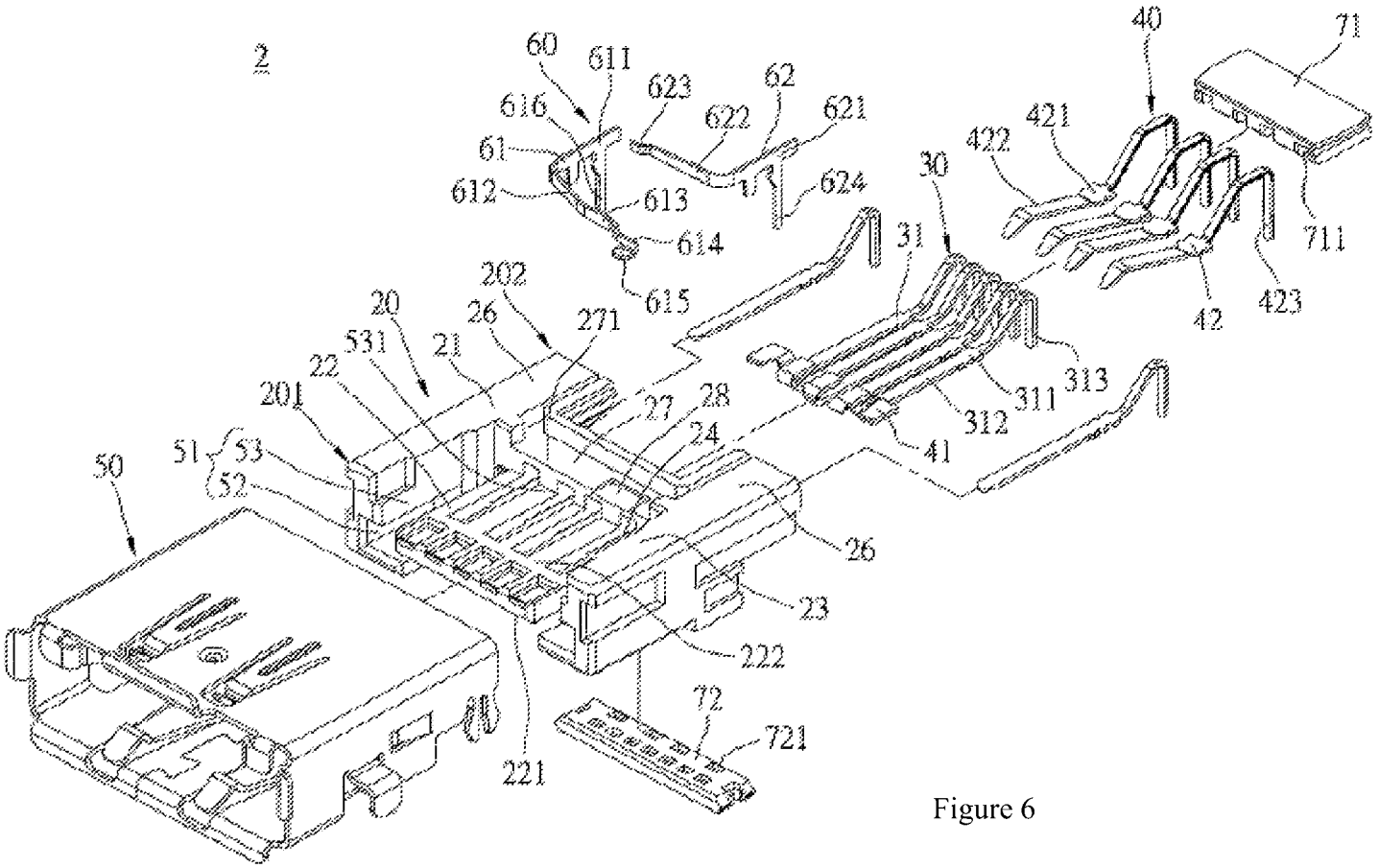
FIG. 6 is a three-dimensional exploded view of the socket connector in the present invention.
Figure 15:
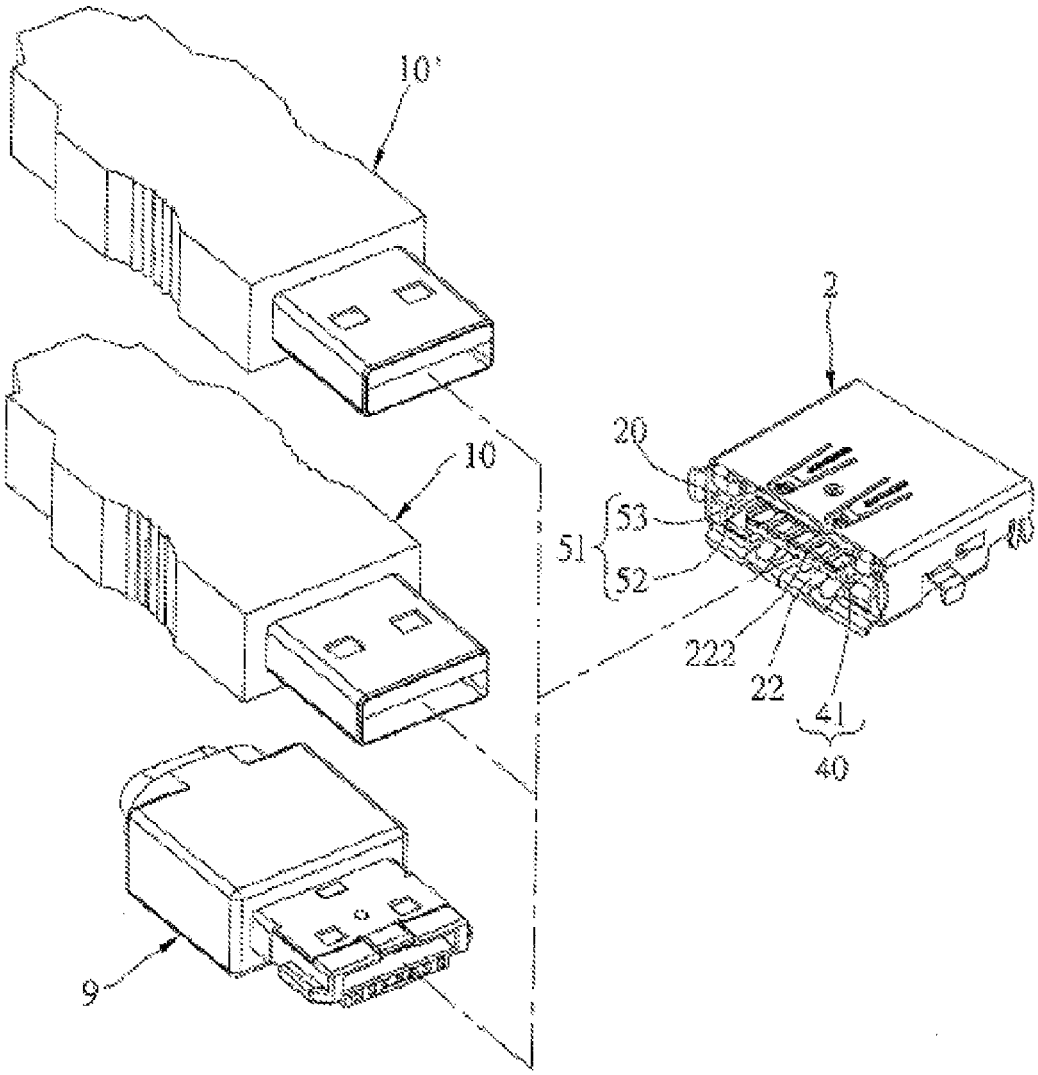
FIG. 15 is a three dimensional view of the socket connector in the present invention and the plug-in connector plugged therein.

Referring to FIG. 4 to FIG. 6, in combination with reference to FIG. 15. The present invention provides a socket connector 2. The socket connector 2 can be placed on a circuit board 8 and the socket connector 2 is available for alternate plug-in of externally connected eSATA (external serial advanced technology attachment) (hereinafter referred to as eSATA plug-in connector) plug-in connector 9 and a type A universal serial bus plug-in connector (hereinafter referred to as a USB plug-in connector) 10 or 10'. The socket connector 2 comprises an housing 20, an external serial Advanced Technology attachment (eSATA) terminal set (hereinafter referred to as an eSATA terminal set) 30, a universal serial bus (USB) terminal set (hereinafter referred to as USB terminal set) 40 and a shield 50 and further comprises a detection switch 60.

Housing 20 has an opposite front end 201 and rear end 202 and housing 20 comprises a base part 21, an inserting board 22 connected to base part 21 and extending toward front end 201, as well as side arms 23 that extend forward from the two sides of base part 21. Housing 20 also has four USB terminal slots 24 and two eSATA terminal slots 25 (as shown in FIG. 4) and the two sides of rear end 202 of base part 21 respectively extend a protruding arm 26 backward. Inserting board 22 has an opposite first board surface 221 and second board surface 222. Four USB terminal slots 24 are located side by side on second board surface 222 and extend to rear end 202 of base part 21. Two eSATA terminal slots 25 are located on the two opposite sides of first board surface 221 and extend to rear end 202 of base part 21.

eSATA terminal set circuit 30 has seven terminals 31 side by side. Each terminal 31 of eSATA terminal set 30 has a first base arm 311, a contact arm 312 extending from first base arm 311 and first welded pin 313 bending and extending from the other, opposite end of first base arm 311.

USB terminal set 40 has nine terminals 41 and 42, wherein five terminals 41 are placed side by side on the first USB terminal set. The remaining terminals 42 placed side by side are the second USB terminal set. Five terminals 41 of the first USB terminal set respectively correspond to the five terminals 31 integrally connected to the middle part 30 of the eSATA terminal set, respectively forming a shared terminal structure, wherein each of terminals 42 of the second USB terminal set has a second base arm 421, a flexible contact arm 422 bending and extending from one end of second base arm 421 and a second welded pin 423 bending and extending from the other, opposite end of second base arm 421, wherein the aforementioned USB terminal set 40 with the nine terminals 41 and 42 that are placed side by side are specifically used for transmission of signal transmission protocol of type A connector terminal under USB version 3.0.

Figure 7:
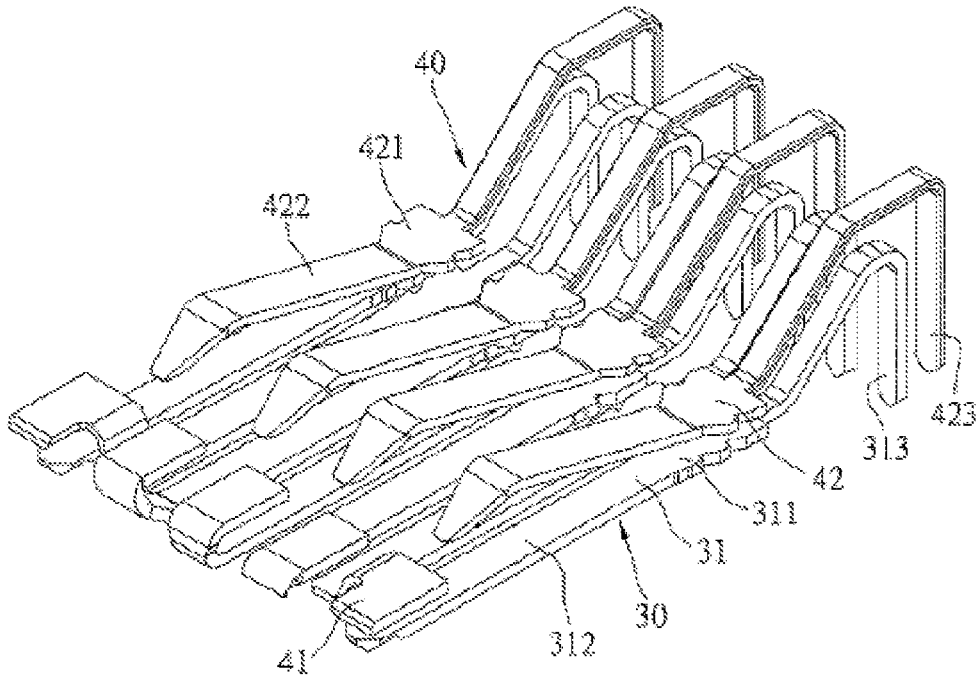
FIG. 7 is a three-dimensional view of the eSATA terminal set and USB terminal set of the socket connector in the present invention.
Figure 8:
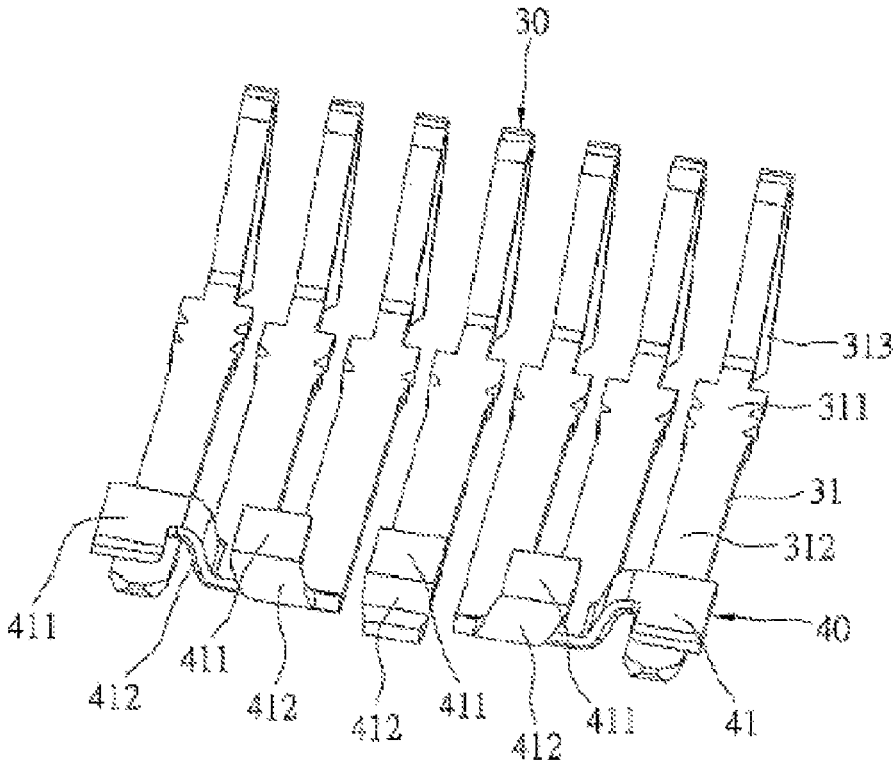
FIG. 8 is a three dimensional top view of FIG. 7.
Figure 9:
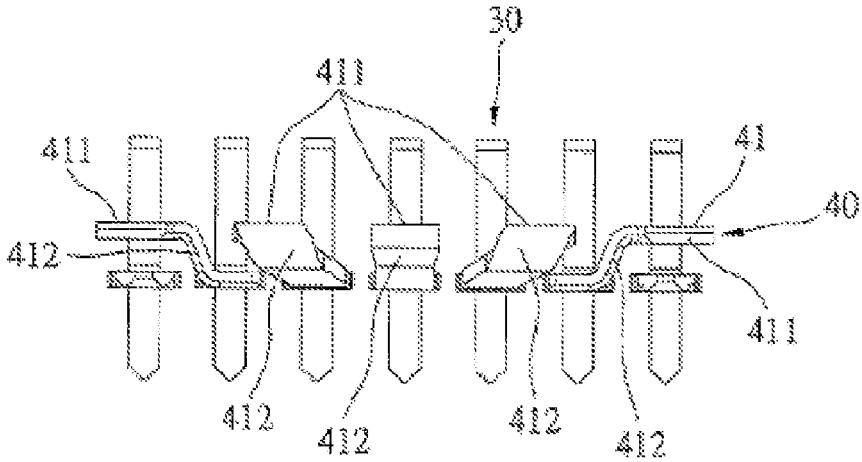
FIG. 9 is a front view of FIG. 7.
Figure 10:
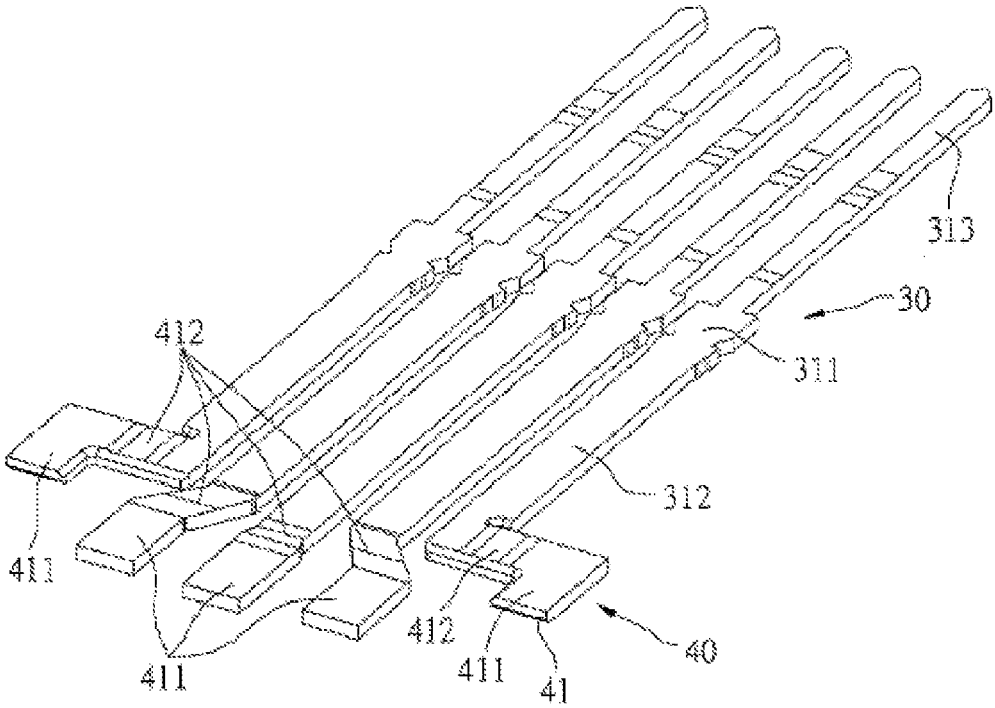
FIG. 10 is an expanded view of the shared terminals of the socket connector in the present invention.

Referring to FIG. 7 to FIG. 9, each of terminals 41 of the first USB terminal set comprises a flat board contact part 411 and a connecting part 412. One end of connecting part 412 is connected to flat board contact part 411, while the other end is connected to corresponding terminal 31 of eSATA terminal set 30, wherein connecting part 411 of middle terminals 41 of the first USB terminal set bends and extends from the end of the corresponding terminal 31 of the eSATA, before forming its flat board contact part 411 in a reverse direction. The connecting parts of the middle terminals 41 on the two sides of the first USB terminal set respectively bend and extend from the ends of the terminals 31 corresponding to the eSATA terminal set 30 and deviate and extend to opposite outer directions, before forming their flat board contact parts 411 in a reverse direction. As depicted, the connecting part 412 of the two terminals 41 on the outermost sides in the USB terminal set extends obliquely in a reverse outer side direction on the side from the opposite side direction near the end of the contact arms of the terminals corresponding to eSATA before extending its flat board contact part 41 in an opposite outer side direction. However, as shown in FIG. 10, which is an expanded view of such shared terminals, the design of such shared terminals makes it possible to expand them on a terminal feed belt without causing interference, thus making it possible to shape such shared terminals by stamping them on a terminal feed belt.

The aforementioned detection switch 60 comprises a first detection terminal 61 and the second detection terminal 62. A pressure contact part 615 protrudes from first detection terminal 61. In a specific embodiment, first detection terminal 61 comprises a first fixed part 611, the aforementioned pressure contact part 615 that bends and extends in the direction of one end of first fixed part 611 and first welded pin 616 that extend from the other end of first fixed part 611. Second detection terminal 62 comprises a second fixed part 621, a contact part 623 that bends and extends from one end of second fixed part 621 and that is located to the rear of pressure contact part 615 and a second welded pin 624 that extends from the other end of second fixed part 621. In a more specific description, first detection terminal 61 also comprises a first flexible arm 612 that bends and extends from first fixed part 611, a pressure contact arm 613 that extends from the end of first flexible arm 612 and a connection arm 614 that bends and extends from the end of contact arm 613. The aforementioned pressure contact part 615 is formed by bending and extending from the side of connecting arm 614 near its end. Second detection terminal 62 also comprises a second flexible arm 622 that bends and extends from second fixed part 621. The aforementioned contact part 623 bends and extends from the end of second flexible arm 622.

Figure 11:
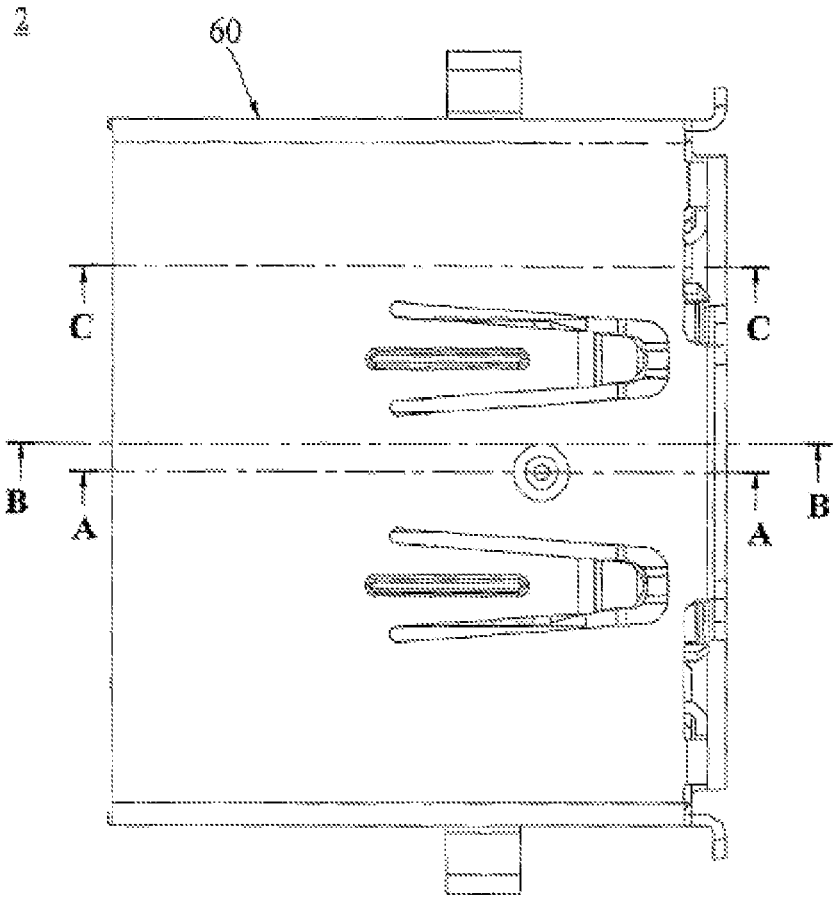
FIG. 11 is a plane view of the socket connector in the present invention.
Figure 12:
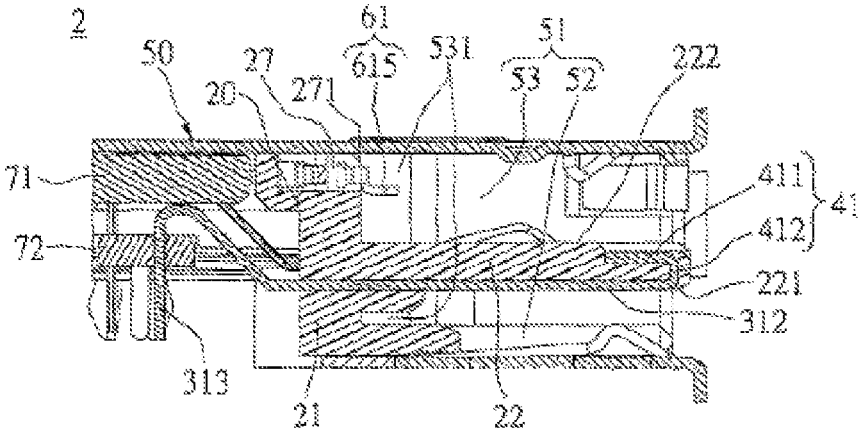
FIG. 12 is an A-A cross-sectional view of FIG. 11.
Figure 13:
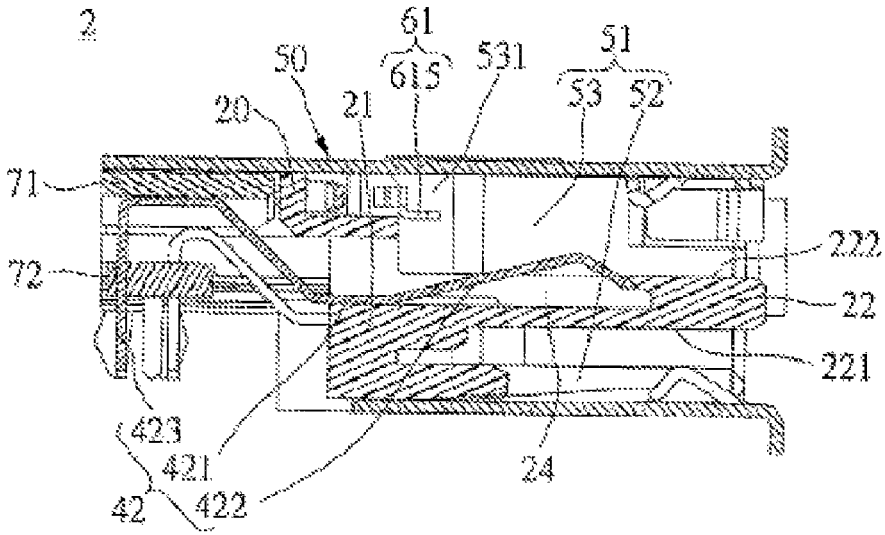
FIG. 13 is a B-B cross-sectional view of FIG. 11.

First board surface 221 of inserting board 22 of housing 20 is for placement of the aforementioned seven terminals 31 of eSATA terminal set 30 placed side by side. Second board surface 222 of inserting board 22 is for placement of the USB terminal set 44 the aforementioned nine terminals 41 and 42, wherein the five terminals 31 of the eSATA terminal set 30 are the five terminals 41 of the first USB terminal set of the shared the terminals, which are placed side by side on front end 201 of the second board surface 222. The remaining four terminals 42 of the second USB terminal set are placed on second board surface 222 and are located to the rear of the first USB terminal set. Please help again by referring to FIG. 11 to FIG. 13. The above shows the first USB terminal set of the shared terminals and five terminals 31 of eSATA terminal set 30 that are disposed on inserting board 22 of housing 20 and that can be disposed on inserting board 22 by insert molding, thus enhancing the bonding strength of housing 20. However, due to the aforementioned designs for shared terminals, they can be shaped by being stamped on a metal feed belt. Therefore, after being shaped, they can be inserted and molded together on inserting board 22 of housing 20, to facilitate work during the manufacturing process. Also, terminals 41 of shared first USB terminal set are connected to connecting part 412 of terminals 31 of eSATA terminal set 30, and they have similar lengths and widths, thus making it possible to have close signal transmission paths, reducing and resolving the deflection of signal transmission for the transmission of USB signals and avoiding the occurrence of signal misjudgment and distortion. This will also reduce impedance effect and reduce the delay or distortion of USB signal transmission.

In addition, in a specific implementation, contact arms 312 of terminals 31 of eSATA terminal set 30 are placed side by side on first board surface 221. Flat board contact parts 411 of the first USB terminal set are placed side by side on the front end 201 of first board surface 221. Four terminals 42 of the second USB terminal set are inserted into corresponding USB terminal slots 24. Second base arms 421 are fastened into USB terminal slots 24 of base part 21. Flexible contact arms 422 are located on second board surface 222 and protrude and extend out of corresponding USB terminal slots 24, whereas second welded pin 423 extends from rear end 202 located on base part 21. Two terminals 31 that are located on the outermost sides of eSATA terminal set 30 are inserted into corresponding eSATA terminal slots 25. First base arms 311 of two terminals 31 are fastened into eSATA terminal slots 25 of base part 21. Contact arms 312 are located in eSATA terminal slots 25 of first board surface 221 and each of the first welded pins 313 of eSATA terminal set 30 extends out of rear end 202 of base part 21.

Figure 14:
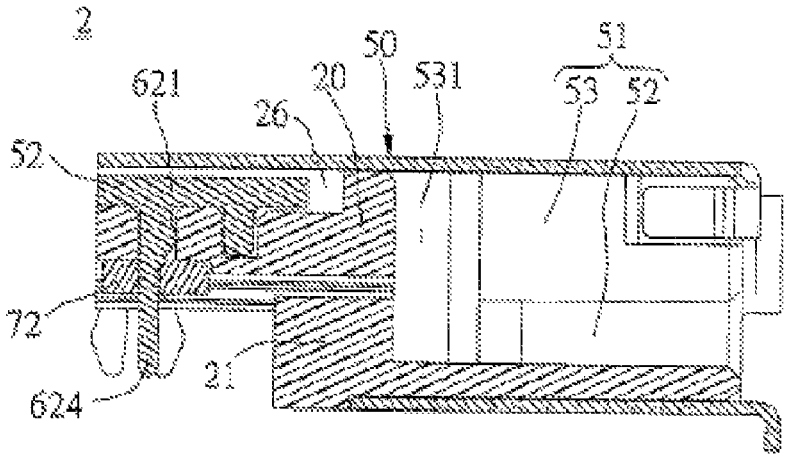
FIG. 14 is a C-C cross-sectional view of FIG. 11.

Shield 50 covers housing 20 and together with housing 20 comprise a shared inserting space 51. Detection switch 60 is placed on housing 20, wherein shared inserting space 51 comprises a first inserting space 52 for plugging in the aforementioned eSATA plug-in connector 9 and an inserting space 53 for plugging in USB connector 10 or 10'. First inserting space 52 and second inserting space 53 have a partial overlapping space and a partial non-overlapping space 531. Pressure contact part 615 of first detection terminal 61 protrudes out and extends into the second inserting space 53 on one side of the second board surface 222 of inserting board 22 and is located in the non-overlapping partial space 531 of first inserting space 52 and second inserting space 53. In a more specific embodiment, base part 21 of housing 20 is sunken for installation of installation slot 27 of detection switch 60. Installation slot 27 has an opening 271 toward the direction of the second inserting space 53 on one side of second board surface 222. The pressure contact part 615 of first detection terminal 61 protrudes out of the opening 271, and the inner wall surface of opening 271 of the installation slot 27 has a sunken part 28. First fixed parts 611 and second fixed parts 621 of first detection terminal 61 and second detection terminal 62 are affixed in installation slot 27 of housing 20. Second flexible arm 622 and pressure contact 623 are located to the rear of connecting arm 614 and pressure contact arm 613. Pressure contact arm 613 corresponds to contact part 623. Pressure contact part 615 protrudes out of opening 271 of installation slot 27. It protrudes and extends into the non-overlapping partial space 531 on one side of the aforementioned second board surface 222 and corresponds to sunken part 28, whereas first welded pin 616 and second welded pin 624 respectively thread out of housing 20 (as shown in FIG. 14).

Referring to FIG. 15, a first inserting space 52 of shared inserting space 51 of socket connector 2 is for plugging in the aforementioned eSATA plug-in connector 9. A second inserting space 53 is for plugging in of type A USB plug-in connector 10 that meets USB 3.0 protocol. Of course, it can also be used for plugging in type A USB plug-in connector 10' under USB 2.0 transmission protocol.

Figure 16:
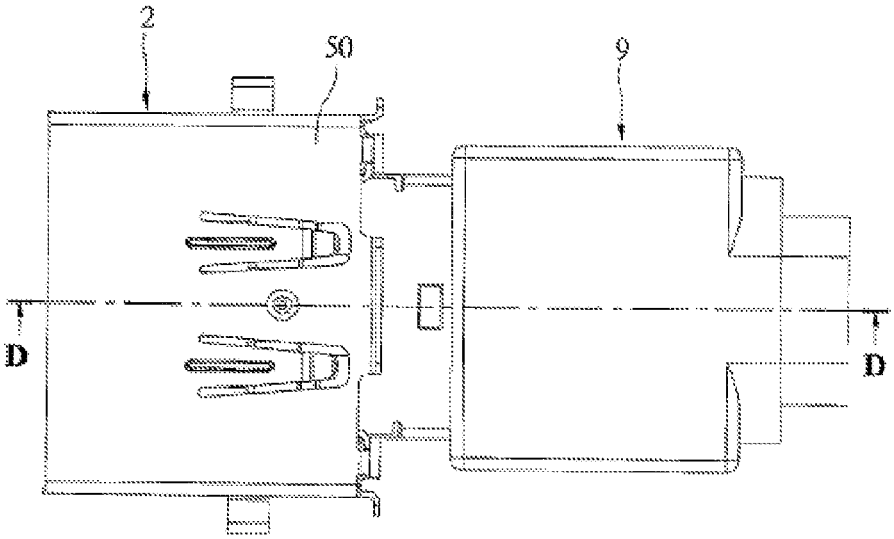
FIG. 16 is a plane view of the socket connector in the present invention plugged into an eSATA plug-in connector.
Figure 17:
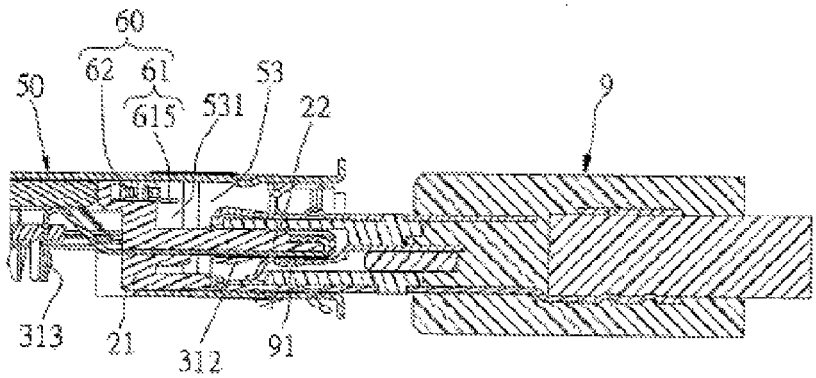
FIG. 17 is a D-D cross-sectional view of FIG. 16.
Figure 18:
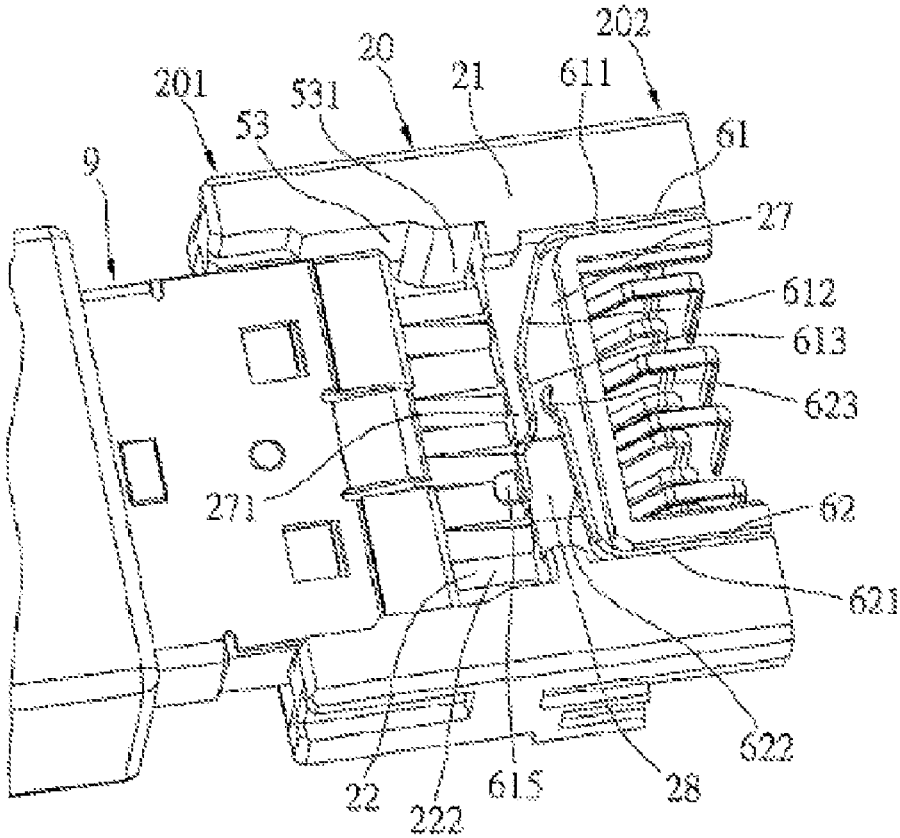
FIG. 18 is a three-dimensional view of the socket connector in the present invention plugged into an eSATA plug-in connector, wherein the shield has been removed.

Referring to FIG. 16 to FIG. 18, the plug-in status of the eSATA plug-in connector is clearly shown. As shown in FIG. 18, the shield is removed; when eSATA plug-in connector 9 is plugged into the socket connector 2 until it is positioned, contact arm 312 of terminal 31 of eSATA terminal set 30 comes into contact with terminal 91 corresponding to eSATA plug-in connector 9 and is electrically broken over. Also, eSATA plug-in connector 9 is located in first inserting space 52 and will not press against detection switch 60, it will not change the connection status of detection switch 60, so that eSATA terminal set 30 of socket connector 2 will transmit the eSATA signal.

Figure 19:
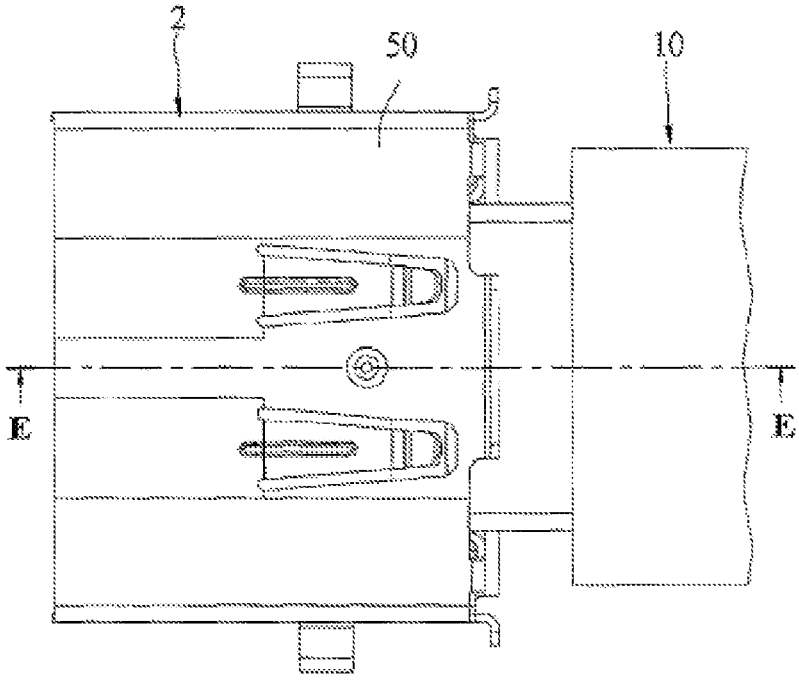
FIG. 19 is a plane view of the socket connecting the present invention plugged into a USB plug-in connector.
Figure 20:
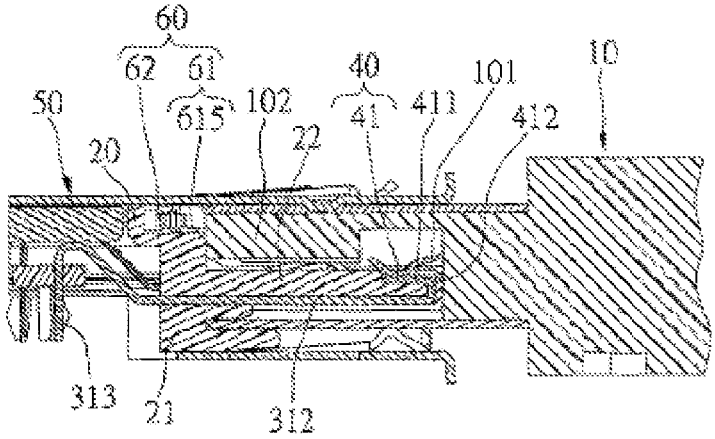
FIG. 20 is an E-E cross-sectional view of FIG. 19.
Figure 21:
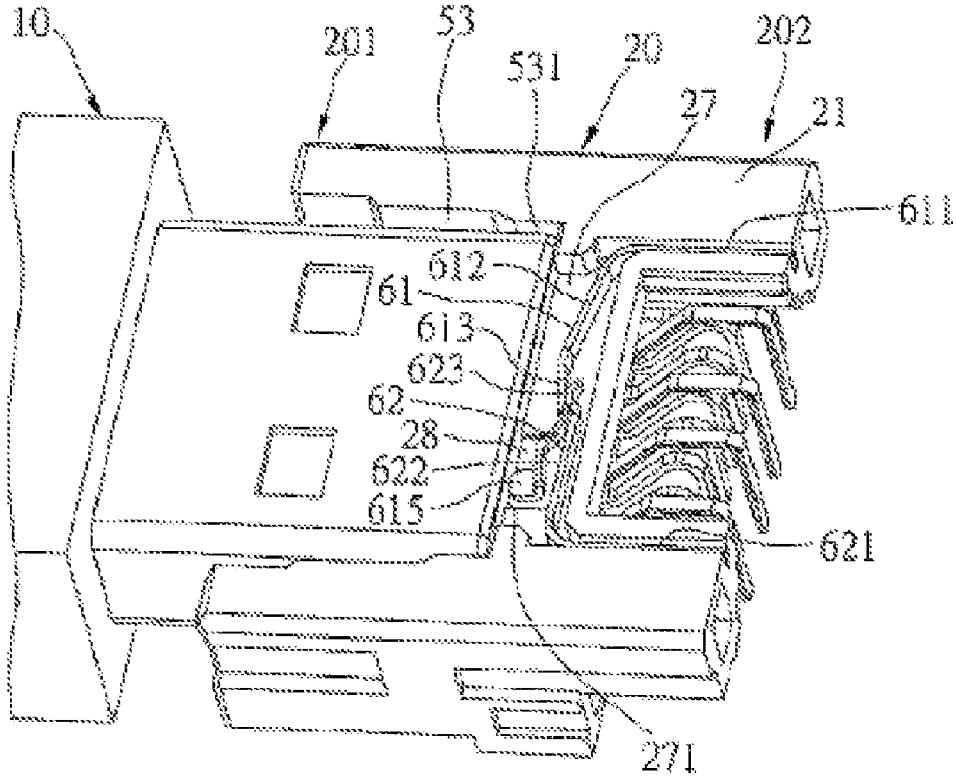
FIG. 21 is a three-dimensional view of the socket connector in the present invention after it is plugged into a USB plug-in connector, wherein the shield has been removed.
Figure 22:
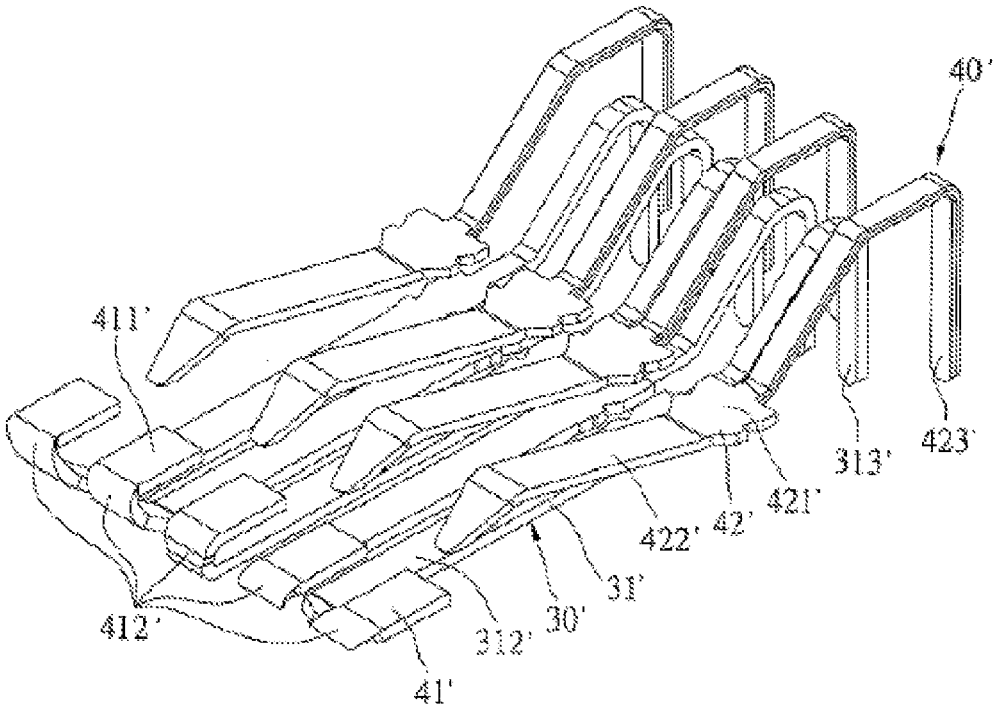
FIG. 22 is a three-dimensional view of the eSATA terminal set and USB terminal set of the socket connector in another embodiment of the present invention.
Figure 23:
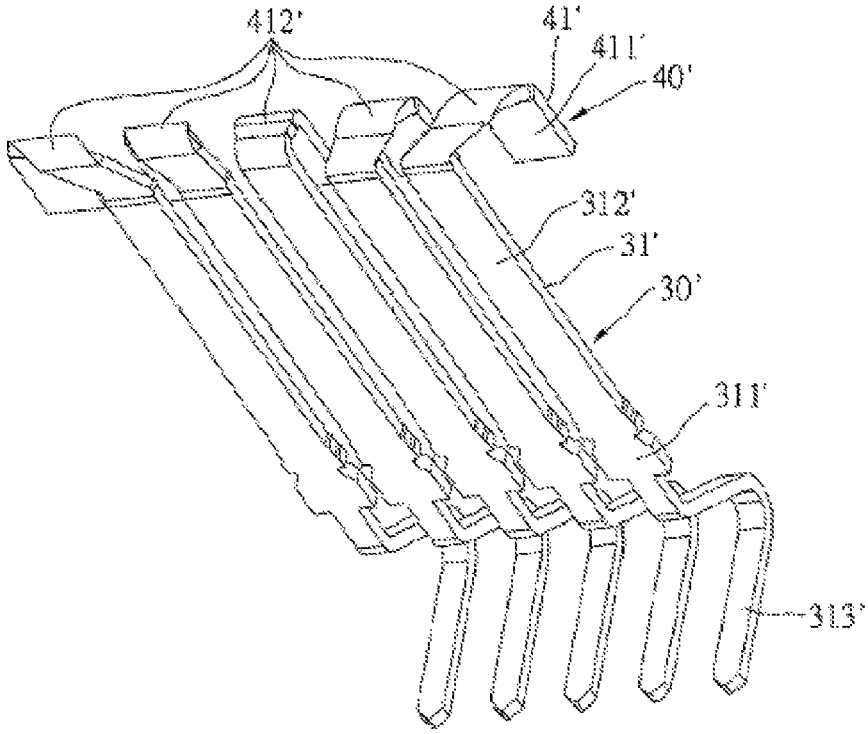
FIG. 23 is a three dimensional top view of FIG. 22.
Figure 24:
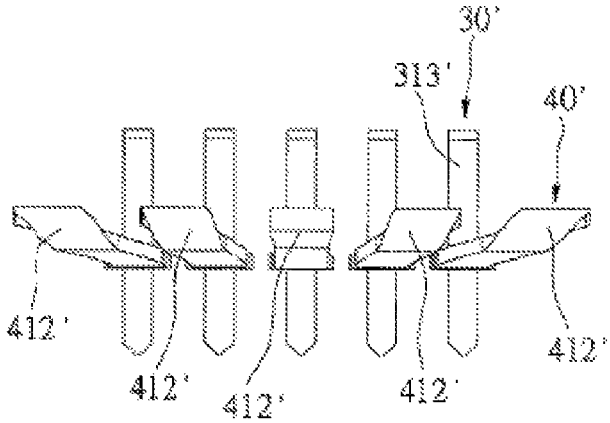
FIG. 24 is a front view of FIG. 22.
Figure 25:
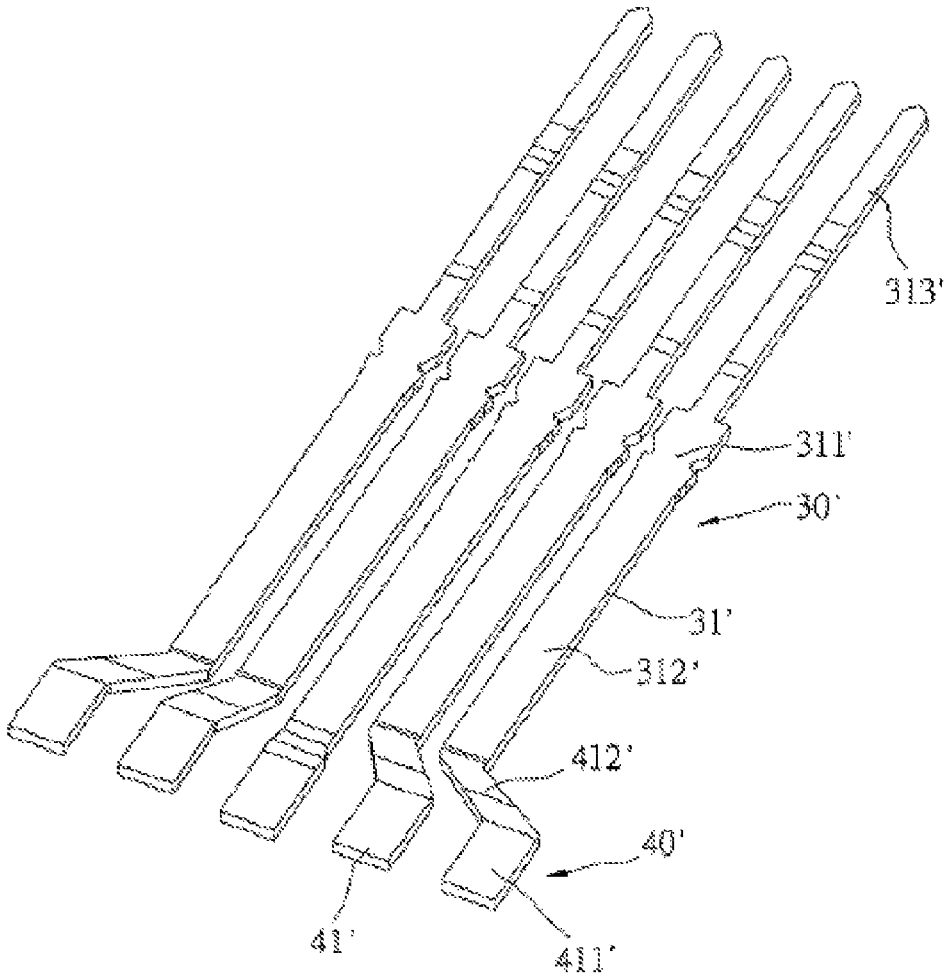
FIG. 25 is an expanded view of the shared terminals of the socket connector in another embodiment of the present invention.

Looking at FIG. 19 to FIG. 21, which also clearly show the plug-in status of the USB plug-in connector. As shown in FIG. 21, the shield is removed. After USB plug-in connector 10 with USB 3.0 protocol is plugged into socket connector 2, contact parts 411 of various terminals 41 of the first USB terminal set of USB terminal set 40 are electrically broken over due to contact with the nine terminals 101 of flexible contact arms 422 of the second USB terminal set by the flexible contact arms 422 of the second USB terminal set that can make such contact. After USB plug-in connector 10 is inserted into second inserting space 53, it will be located in non-overlapping partial space 531 between first inserting space 52 and second inserting space 53. Therefore, insulating casing 102 of the USB plug-in connector 10 will press against pressure contact part 615 of first detection terminal 61 of detection switch 60, thus pushing pressure contact part 615 and causing first detection terminal 61 to actuate second detection terminal 62, thus breaking over detection switch 60 in order to change the connection status of detection switch 60, so that terminal 31 in eSATA terminal set 30 that is connected to terminal 41 of first USB terminal set transmits the transmission signal of USB. There is a further description: as shown in FIG. 20 and FIG. 21, after USB plug-in connector 10 is plugged in, the front end of its insulating casing will press against pressure contact part 615 of first detection terminal 61, so that pressure contact part 615 moves toward the direction of rear end 202 and is positioned in sunken part 28, while at the same time causing contact arm 613 to press against contact part 623 of second detection terminal 62, thus breaking over detection switch 60. Therefore, with placement of detection switch 60, USB plug-in connector 10 is plugged into switch terminal 31 of the shared eSATA terminal set 30, to provide the functions of transmission of the USB signal. Also, based on the specific need, the transmission signal and power and tests with equipment end turned off can be further combined and provided for provision of power or the need for other detection functions can be met. In addition, when the front end of insulating casing 102 of USB plug-in connector 10 is used to press against pressure contact part 515 of first detection terminal 51, it will further stabilize the signal switch of detection switch 50 without causing any misjudgment of the switch signal.

In addition, please again refer to FIG. 6. Socket connector 2 further comprises a terminal positioning seat 71 and a terminal holding block 72. Four sunken slots 711 are placed side by side inside terminal positioning seat 71, whereas terminal holding block 72 has a plurality of threading slots 721. Terminal positioning seat 71 is fastened onto two protruding arms 26 of housing 20, whereas second welded pins 423 of the second USB terminal set of USB terminal set 40 are respectively positioned in corresponding sunken slots 711, in order to position second welded pins 423. Terminal holding block 72 is also fastened onto two protruding arms 26 of housing 20 and located on one side of terminal positioning seat 71. First welded pins 313 of each of terminals 31 of eSATA block 30 and each of second welded pins 423 of the second USB terminal set of USB terminal set 40 respectively thread out of corresponding threading slots 721, in order to fasten first welded pins 313 and second welded pins 423. Through terminal positioning seat 71 and terminal holding block 72, the manufacturing process of welding eSATA terminal set 30 and the second USB terminal set in the USB terminal set 40 onto circuit board 8 is made easier. In addition, first welded pin 616 and second welded pin 624 of detection switch 60 also thread through threading slots 721 located on the outermost two sides and have the same purpose as described above.

Another embodiment id depicted in FIG. 22 to FIG. 25, which differ from the aforementioned embodiments by the structure of the aforementioned shared terminals. Each of the terminals 41' of the first USB terminal set comprises a flat board contact part 411' and a connecting part 412'. One end of connecting part 412' is connected to flat board contact part 411' and the other end is connected to terminal 31' corresponding to eSATA terminal set 30'. Each connecting part 412' bends and extends from terminal 31' corresponding to eSATA terminal set 30', before forming flat board contact parts 411' in a reverse direction, wherein connecting parts 412' of middle terminals 41' of the first USB terminal set respectively bend and extend from the end of terminal 31' corresponding to eSATA terminal set 30 and then deviate and extend to opposite outer directions, before forming flat board contact part 411' in a reverse direction; connecting part 412' of the two terminals 41' of middle terminals 41' of the first USB terminal set respectively bend and extend from the end of terminal 31' corresponding to eSATA terminal set 30 and then deviates and extends to opposite outer directions, before forming flat board contact part 411' in a reverse direction; whereas connecting part 412' of terminals 41' on the outermost sides of the first USB terminal set extends from the end of terminal 31' corresponding to eSATA terminal set 30 and then deviates and extends to opposite outer directions, before forming flat board contact part 411' in a reverse direction. Wherein, connecting part 412' of each of terminals 41' of the first USB terminal set is connected to the end of contacting arm 312' of terminal 31' corresponding to eSATA terminal set 30'. Connecting part 412' of each of terminals 41' of the first USB terminal set extends to an aligned position at the same level before forming its flat board contact part 411' in a reverse direction.

Since connecting parts 412' connected to terminal 31' corresponding to eSATA terminal set 30 terminals 41' of the shared first USB terminal set have a similar width, this can reduce the impedance effect and reduce the delay or distortion of USB signal transmission.

In addition, in an equivalent, variable implementation, the two terminals 31' located on the outermost two sides of the aforementioned eSATA terminal set 30' can also be extended together with the five shared the terminals in the middle location on the terminal feed belt without interference, thus making it possible for eSATA terminal set 30' to be shaped by being stamped on one terminal feed belt while at the same time being disposed in inserted board 22' by insert molding.

Summarizing the above, through the aforementioned design of a connecting part for shared terminals and with similar length and width, the present invention causes signal transmission paths to be close, thus reducing the deflection in the transmission of a USB signal and avoiding the occurrence of signal misjudgment and signal distortion and reducing the impedance effect and reducing the delay or distortion of USB signal transmission. Also, the design of such shared terminals makes it possible for such shared terminals to be shaped on the terminal feed belt, so that after being shaped, they can be jointly disposed in the inserting board of the housing, to facilitate the manufacturing process and enhance the bonding strength of the housing.

Through the design of the aforementioned connecting part of shared terminals, which has a similar width, the present invention reduces the impedance effect and reduces the delay or distortion of USB signal transmission. Also, the design of such shared terminals makes it possible for such shared terminals to be shaped on the terminal feed belt, so that after being shaped, they can be jointly disposed in the inserting board of the housing, to facilitate the manufacturing process and enhance the bonding strength of the housing.

Next, by designing a second inserting space that has a detection switch, that is located in a USB plug-in connector and that avoids the inserting space of an eSATA plug-in connector, the eSATA plug-in connector will not trigger the detection switch and will only trigger the detection switch when the USB plug-in connector is plugged in. In a composite inserting space, the detection functions of a USB plug-in connector that is plugged in are provided. Therefore, when an eSATA plug-in connector is plugged in, it will not push against the pressure contact part of the first detection terminal and will not change the connection status of the detection switch, thus enabling the eSATA terminal set of the socket connector to transmit a signal. When a corresponding USB plug-in connector is plugged in, it will press against the pressure contact part of the first detection terminal, thus changing the connection status of the detection switch, enabling the terminal in the eSATA terminal set connected to the USB terminal set to transmit the USB transmission signal. At the same time, the detection switch can also provide signal and power for the USB plug-in connector after it is plugged in and positioned, or provide power to detect the USB plug-in connector after it is plugged in and positioned when the equipment end has been turned off or meet other demands required for detection functions.

The above description only involves the preferred and feasible embodiments of the present invention and shall not limit the scope of the patent of the present invention. Therefore, an equivalent structural change by using the specifications and contents of the figures of the present invention shall, by the same token, be included in the scope of the present invention.

The invention claimed is:

1. A socket connector, comprising:

a housing, with a front end and a rear end, the housing including a base part and an inserting board connected to the base part, wherein the inserting board has a first board surface and a second board surface opposite to each other;

an External Serial Advanced Technology Attachment terminal set with seven terminals side by side provided on the first board surface;

a universal serial bus (USB) terminal set with nine terminals provided on the second board surface, wherein five of the USB terminal set being placed side by side are a first USB terminal set and the remaining four terminals placed side by side are a second USB terminal set, wherein the first USB terminal set is placed on the front end of the second board surface; the second USB terminal set is placed on the second board surface and is located at the rear of the first USB terminal set, wherein five of the terminals side by side of the first USB terminal set are respectively and correspondingly connected to the five terminals at a central location of the External Serial Advanced Technology Attachment terminal set, constituting the structure for a shared terminal; and a shield, wherein the shield covers the housing and constitutes a shared inserting space, the shared inserting space including a first inserting space for plugging in an eSATA plug-in connector and a second inserting space for plugging in a corresponding type A USB plug-in connector, wherein the first inserting space and the second inserting space have a partial overlapping space and a partial non-overlapping space;

a detection switch supported by the housing, wherein the detection switch comprises a first detection terminal and a second detection terminal;

a pressure contact part that protrudes from the first detection terminal, wherein the contact part protrudes out and extends into the second inserting space on the side of the second board surface of the inserting board and is located in the non-overlapping partial space of the first inserting space and the second inserting space, wherein, in operation, when the eSATA plug-in connector is inserted into the second inserting space, it will not be pressed against the pressure contact part of the first detection terminal and wherein when the USB plug-in connector is inserted into the second inserting space, it will be pressed against the pressure contact part of the first detection terminal, so that the first detection terminal moves relative to the second detection terminal.

2. The socket connector according to claim 1, wherein the first detection terminal comprises a first fixed part affixed onto the housing, the pressure contact part bending and extending from the direction of one end of the fixed part and the first welded pin extending from the other end of the fixed part, wherein the second detection terminal comprises a second fixed part affixed onto the housing, a contact part that bends and extends from the direction of one end of the second fixed part and that is located in the rear of the pressure contact part as well as a second welded pin extending from the other end of the second fixed part and the housing has an installation slot for installation of the detection switch, wherein the installation slot has an opening toward the direction of the second inserting space on one side of the board surface, wherein the pressure contact part of the first detection terminal protrudes out of the opening.

3. The socket connector according to claim 1, wherein the connector is configured so that when an USB plug-in connector is inserted into the second inserting space, the front end of the insulating casing of the USB plug-in connector correspondingly presses against the pressure contact part of the first detection terminal of the detection switch.

4. The socket connector according to claim 1, wherein each of the terminals of the External Serial Advanced Technology Attachment has a first base arm, a contact arm extending from the first base arm and the first welded pin extending from the other, opposite end of the first base arm, wherein the contact arms are located side by side on the first board surface of the inserting board, wherein the first welded pins extend out of the rear end of the base part and each of the terminals of the second USB terminal set has a second base arm, a flexible contact arm bending and extending from one end of the second base arm and a second welded pin bending and extending from the other, opposite end of the second base arm, wherein the flexible contact arms are located side by side on the second of the inserting board, wherein the second welded pins extend out of the rear end of the base part.

5. The socket connector according to claim 4, wherein the shared terminal is disposed into the inserting board of the housing.

6. The socket connector according to claim 5, wherein the housing has four USB terminal slots and two eSATA terminal slots, wherein the aforementioned four USB terminal slots are located side by side on the second board surface and extend to the rear end of the base part, wherein the aforementioned eSATA terminal slots are located on the two opposite sides of the first board surface and extend to the rear end of the base part; the first base arms of the two terminals on the outermost sides of the External Serial Advanced Technology Attachment are fastened onto the corresponding eSATA terminal slots and the contact arms are located in the corresponding eSATA terminal slots, and wherein the second base arms of each of the terminals of the second USB terminal set are fastened into the corresponding USB terminal slots and the flexible contact arms are located in the corresponding USB terminal slots.

7. The socket connector according to claim 6, wherein each of the terminals of the first USB terminal set comprises a flat board contact part and a connecting part and one end of the contact part is connected to the flat board contact part, while the other end is connected to the terminal corresponding to the External Serial Advanced Technology Attachment terminal set.

8. The socket connector according to claim 7, wherein the connecting part of the middle terminals of the first USB terminal set bends and extends from the end of the corresponding terminal of the External Serial Advanced Technology Attachment, before forming the flat board contact part in a reverse direction, wherein the connecting parts of the middle terminals on the two sides of the first USB terminal set respectively bend and extend from the ends of the contact arms of the terminals corresponding to the terminal set of the External Serial Advanced Technology Attachment and deviate and extend to opposite outer directions, before forming their flat board contact parts in a reverse direction, wherein the connecting part of the two terminals on the outermost sides in the USB terminal set extends obliquely in a reverse outer side direction on the side from the opposite also side direction near the end of the contact arms of the terminals corresponding to the External Serial Advanced Technology Attachment before extending its flat board contact part in an opposite outer side direction.

9. The socket connector according to claim 8, wherein a protruding arm extends from the two sides on the rear end of the base part of the housing and a terminal positioning seat is fastened onto the two protruding arms, and four sunken slots are placed side by side inset terminal positioning seat, wherein the second welded pins of the second USB terminal set are respectively positioned in the corresponding sunken slots.

10. The socket connector according to claim 9, wherein a terminal holding block for the protruding arm of the housing is also fastened onto one side of the terminal positioning seat, wherein the terminal holding block has a plurality of inserting slots, wherein the first welded pins of each of the terminals of the External Serial Advanced Technology Attachment terminal set and the second welded pins of each of the blocks of the second USB terminal set respectively thread out of the corresponding threading slots.

11. The socket connector according to claim 2, the aforementioned USB terminal set with nine terminals placed side by side are in compliance with the signal transmission protocol for type A connector terminals with a version under USB 3.0.

* * * * *